US010329108B2

(12) United States Patent
Beletsky et al.

(10) Patent No.: US 10,329,108 B2
(45) Date of Patent: Jun. 25, 2019

(54) SYSTEM AND METHOD FOR DETECTING A MEDIA SUPPLY

(71) Applicant: Carestream Health, Inc., Rochester, NY (US)

(72) Inventors: Andrei Beletsky, Woodbury, MN (US); James R. Gilbertson, Oakdale, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 16/025,219

(22) Filed: Jul. 2, 2018

(65) Prior Publication Data

US 2019/0062092 A1 Feb. 28, 2019

Related U.S. Application Data

(60) Provisional application No. 62/550,150, filed on Aug. 25, 2017, provisional application No. 62/598,617, filed on Dec. 14, 2017.

(51) Int. Cl.

| | |
|---|---|
| ***B65H 7/14*** | (2006.01) |
| ***B65H 1/04*** | (2006.01) |
| ***B65H 7/04*** | (2006.01) |
| ***B41J 11/00*** | (2006.01) |

(52) U.S. Cl.

CPC ..... *B65H 7/14* (2013.01); *B41J 11/0075* (2013.01); *B65H 1/04* (2013.01); *B65H 7/04* (2013.01); *B65H 2220/03* (2013.01); *B65H 2408/13* (2013.01); *B65H 2511/152* (2013.01); *B65H 2557/512* (2013.01)

(58) Field of Classification Search

CPC ... B65H 1/00; B65H 1/04; B65H 7/02; B65H 7/04; B65H 7/14; B65H 2405/10; B65H 2405/11; B65H 2511/13; B65H 2511/152; B65H 2408/13; B65H 2557/512; B41J 29/10; B41J 29/12; B41J 29/13; B41J 29/377; B41J 11/0075; B41J 11/64

See application file for complete search history.

(56) References Cited

U.S. PATENT DOCUMENTS

| | | | | |
|---|---|---|---|---|
| 5,056,331 | A * | 10/1991 | Lotz | B41J 29/13 165/80.3 |
| 5,629,672 | A * | 5/1997 | Brown | B65H 1/266 340/540 |
| 6,139,005 | A | 10/2000 | Nelson et al. | |
| 6,260,842 | B1 | 7/2001 | Nelson et al. | |
| 6,636,704 | B2 * | 10/2003 | Weaver | B41J 11/0075 399/23 |

(Continued)

FOREIGN PATENT DOCUMENTS

| | | | | |
|---|---|---|---|---|
| JP | 57160844 | A * | 10/1982 | B65H 7/04 |

*Primary Examiner* — Prasad V Gokhale

(57) ABSTRACT

A system for detecting the level of a media supply in a printer has a frame having a support for seating the printer thereon. A first light source is positioned on the support and is energizable to direct a first beam of light into the printer. A first detector is positioned on the support and provides an analog signal in response to reflection of the first beam of light from within the printer. A control logic processor is in signal communication with the first detector and compares the analog signal to a stored/predetermined value and reports a low media condition according to the comparison.

16 Claims, 9 Drawing Sheets

(56) References Cited

U.S. PATENT DOCUMENTS

| | | | | |
|---|---|---|---|---|
| 6,661,979 | B2 | 12/2003 | Barlow | |
| 6,883,796 | B2 | 4/2005 | Nelson | |
| 6,929,417 | B2 | 8/2005 | Boudreau | |
| 2010/0032883 | A1* | 2/2010 | Cahill | B65H 29/60 271/3.14 |
| 2010/0322689 | A1* | 12/2010 | Ohtani | B65H 1/04 399/388 |
| 2016/0065772 | A1* | 3/2016 | Lewis | H04N 1/00689 358/1.14 |
| 2016/0101955 | A1* | 4/2016 | Koseki | B65H 7/04 271/265.02 |
| 2017/0092036 | A1 | 3/2017 | Wiens et al. | |

* cited by examiner

SYSTEM AND METHOD FOR DETECTING A MEDIA SUPPLY

CROSS REFERENCE TO RELATED APPLICATIONS

Priority is claimed to U.S. Provisional application Ser. No. 62/550,150, provisionally filed on Aug. 25, 2017, entitled "SYSTEM AND METHOD FOR DETECTING A MEDIA SUPPLY", in the names of Andrei Beletsky and James R. Gilbertson, which is incorporated herein by reference in its entirety.

Priority is claimed to U.S. Provisional application Ser. No. 62/598,617, provisionally filed on Dec. 14, 2017, entitled "SYSTEM AND METHOD FOR DETECTING A MEDIA SUPPLY", in the names of Andrei Beletsky and James R. Gilbertson, which is incorporated herein by reference in its entirety.

FIELD OF THE INVENTION

The disclosure relates generally to the field of imagers/printers, and in particular to a system and method for maintaining and distributing sheets of media. More specifically, the disclosure relates to a system and method for detecting a low media supply in a printer.

BACKGROUND

Media, for example paper or light sensitive, photothermographic film media, is used in many applications ranging from a standard photocopying apparatus, to graphic arts and/or medical imaging/recording printing systems. For example, in the medical industry, printing and imaging systems can range from more conventional printers that record textual, numeric, and graphical information onto paper media to high-performance laser imaging systems employing photothermographic film, such as are commonly used to produce photographic images from digital image data generated by magnetic resonance (MR), computer tomography (CT) or other types of scanners. Imaging systems that provide images from scanning systems typically include a laser imager for exposing an image on the photothermographic film, a thermofilm processor for developing the film through the application of heat, and an image management subsystem for coordinating the operation of the laser imager and the thermofilm processor. The resulting image is available for diagnostic use by medical radiologists and for communication to referring physicians and their patients.

Exemplary printers that are particularly suitable for printing medical x-ray images and other images used for diagnosis are known, for example, Carestream DryView Laser Imager (models include 5950 and 6950). Generally speaking, a photosensitive film laser imager includes a film supply system, a film exposure assembly, a film processing station (or developer), a film dispensing area and a film transport system. Each of these components are associated within a relatively large imager housing.

Sheets of unexposed photosensitive film are normally stacked in a sealed, standardized film cartridge, for delivery to the imager. The standard film cartridge can be sealed by a foil cover. During use, the film cartridge is inserted into the film supply system of the imager. The film supply system normally includes mechanisms for unsealing the film cartridge and subsequently removing individual sheets of film. In this regard, the film supply system separates and delivers an individual sheet of photosensitive film from the film cartridge to the film transport system. The film transport system, in turn, delivers the individual sheet of film to the film exposure assembly. Within the film exposure assembly, photographic images are exposed on the film from image data (e.g., digital or analog) using a laser imager. The exposed sheet of film is then transported, via the film transport system, to the film processing station where the film is developed. After thermal processing, the film is cooled and transported to the film dispensing area where the final image is available to the user.

The film supply system can be referred to as a Pickup Assembly, having an integrated pickup mechanism and a feed roller mechanism. The pickup mechanism separates the top sheet of film from the rest of the film supply/pack and lifts the film sheet into an open set of rollers in the feed roller mechanism. The feed roller mechanism then closes its set of transport rollers and transports the film into a Vertical Transport Assembly.

In various parts of the world, print kiosks are becoming widely used as print-on-demand systems for printing of medical data and images. Print kiosks can be configured with a variety of printer types, including both conventional off-the-shelf paper printers, monochrome or full-color, and high-performance laser-based film imagers.

While systems based on this model can provide suitable levels of performance and usability, there remains some room for improvement. In order to provide uninterrupted printing operation without requiring continuous monitoring and attendance by staff personnel, it is desirable that the media supply level be adequately tracked, so that a low paper or low film media condition can be detected and reported for correction before printing is interrupted.

Various methods for media supply tracking have been applied to other printer types. With today's high-performance imaging systems that record images onto film at high resolution, sufficient data for precise media tracking is often provided by the imager itself, commensurate with the cost of the system and media and with the need to maintain adequate levels of printer consumables in order to support imaging in the print-on-demand environment.

With more conventional paper printer equipment, however, media level tracking and reporting can be minimal and, even where provided, can be poorly suited to the demands of the print-on-demand kiosk environment. It may be difficult or impossible to provide accurate print media level information for support personnel without some type of printer reconfiguration or adding components within the printer. It is recognized that reconfiguration or invasive rework affecting print handling could affect printer performance and reliability as well as jeopardize printer warranty. Standard solutions that simply maintain a media count, measure relative stack thickness such as using surface contact or a magnetic threshold, or that test for successive lead edges, for example, can prove inaccurate or difficult to setup or adjust. Moreover, conventional measurement techniques may use sensing devices or mechanisms that are poorly suited to media type and packaging arrangements. Thus, it can be appreciated that there is a need for low media monitoring methods that are appropriate for applications for providing on-demand medical images and information to patients and health care providers.

SUMMARY

An object of the present disclosure is to address the problem of detecting a low media supply in a printer.

Advantageously, embodiments of the present disclosure describe methods and mechanisms that provide non-contact media level sensing that is adaptable to different printer types and can be used with a range of print media substrates.

These objects are given only by way of illustrative example, and such objects may be exemplary of one or more embodiments of the invention. Other desirable objectives and advantages inherently achieved may occur to or become apparent to those skilled in the art. The invention is defined by the appended claims.

According to one aspect of the disclosure, there is provided a system and method for detecting a low media supply in a printer. The system comprises: a frame having a support/shelf for seating the printer thereon; a first light source that is positioned on the shelf and that is energizable to direct a first beam of light into the printer; a first detector that is positioned on the shelf and that provides an analog signal in response to reflection of the first beam of light from within the printer; and a control logic processor that is in signal communication with the first detector and that compares the analog signal to a predetermined/stored value and reports a low media condition according to the comparison.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF EXEMPLARY EMBODIMENTS

Figure 1:
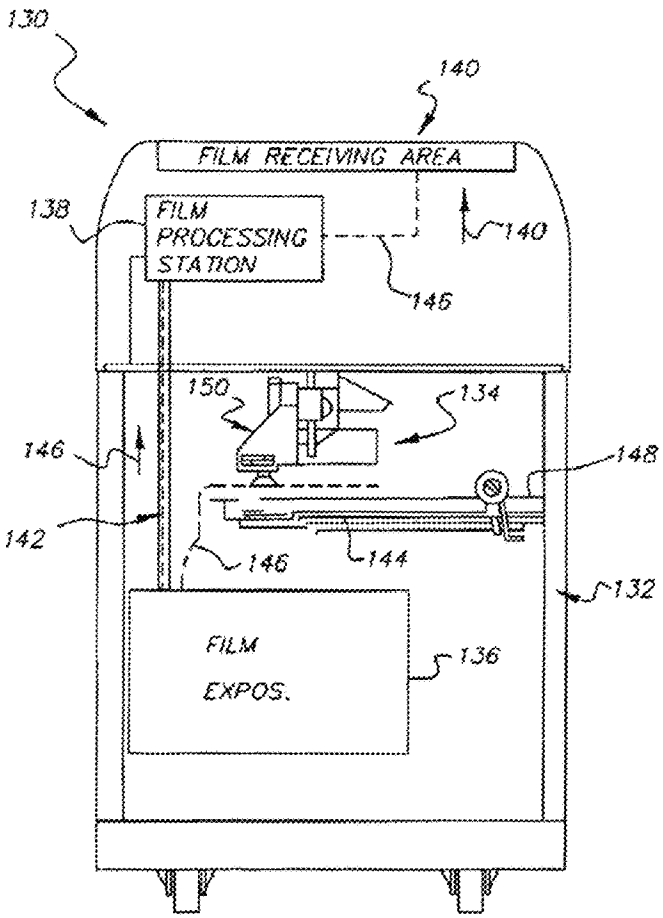
FIG. 1 (Prior art)
FIG. 1 is a schematic diagram that shows components of a laser imaging system using film exposure according to an embodiment of the present disclosure.

The following is a detailed description of the embodiments of the invention, reference being made to the drawings in which the same reference numerals identify the same elements of structure in each of the several figures.

The following references are incorporated herein in their entirely by reference: U.S. Pat. No. 6,883,796 (Nelson) entitled FILM SUPPLY SYSTEM FOR USING WITH A PHOTOSENSITIVE FILM IMAGER; U.S. Pat. No. 6,139,005 (Nelson) entitled FILM SUPPLY SYSTEM FOR USE WITH A PHOTOSENSITIVE FILM IMAGER; and U.S. Pat. No. 6,260,842 (Nelson) entitled FILM SUPPLY FOR USE WITH A PHOTOSENTIVE FILM IMAGER. These references are directed to film supply systems for use with a photosensitive film imager.

Reference is made to the following references, each of which is incorporated herein in their entirety: U.S. Pat. No. 6,661,979 (Barlow) entitled: SYSTEM AND METHOD FOR DETECTING LOW PAPER IN A PRINTER USING CONTINUOUSLY VARIABLE MEASUREMENTS; U.S. Pat. No. 5,629,672 (Brown) entitled: LOW PAPER DETECTION SYSTEM; and U.S. Pat. No. 6,929,417 (Boudreau) entitled: METHODS AND APPARATUS FOR SENSING A PAPER LOW CONDITION FOR FAN-FOLDED TICKETS IN A TICKET PRINTER.

Applicant has developed a method and system to prevent an out-of-media condition at a printer by generating a "low media" or "low paper" alert in advance of media depletion. It is intended to help prevent a situation wherein a customer is unable to print a report or wherein a report is only partially printed and the customer is unaware of it.

As used herein, the term "energizable" relates to a device or set of components that perform an indicated function upon receiving power and, optionally, upon receiving an enabling signal.

In the context of the present disclosure, the phrase "in signal communication" indicates that two or more devices and/or components are capable of communicating with each other via signals that travel over some type of signal path. Signal communication may be wired or wireless. The signals may be communication, power, data, or energy signals. The signal paths may include physical, electrical, magnetic, electromagnetic, optical, wired, and/or wireless connections between the first device and/or component and second device and/or component. The signal paths may also include additional devices and/or components between the first device and/or component and second device and/or component.

The description that follows describes apparatus and methods for tracking media supply levels at a device. With respect to print media management functions described herein, references to "paper" or to "film" in subsequent description can be interpreted broadly to be equivalent, encompassing any suitable type of sheet-based print substrate used for printer devices including photosensitive media. References to "printer" and "imager" can be considered equivalent and can be understood to relate to a range of imager devices that provide images on a substrate sheet, forming image content using exposure to light energy or by applying some type of marking material, such as toner, ink, ribbon-based colorant, or other marking material, to the imaging substrate.

FIG. 1 shows a front view of a laser imaging system 130 incorporating a film supply system in accordance with the present invention. The laser imaging system 130 generally includes an imager housing 132, a film supply system 134, a film exposure assembly 136, a film processing station 138, a film exit area 140 and a film transport system 142. It should be understood that each of the components of the laser imaging system 130 are shown generally in FIG. 1.

The film supply system 134, the film exposure assembly 136, the film processing station 138, the film exit area 140 and the film transport system 142 are all disposed at various locations within the imager housing 132. During use, a cartridge of photosensitive film 144 is placed within the film supply system 134. Upon activation, the film supply system 134 retrieves a single sheet of photosensitive film (not shown). The sheet of photosensitive film is delivered by the film supply system 134 to the film transport system 142 for delivery to the film exposure assembly 136. Within the film exposure assembly 136, photographic images are exposed on the film from image data (e.g., digital or analog), using a laser imager. The thusly exposed film is then transported via the film transport system 142 to the film processing station 138 where the film is developed. After thermal processing, the film is cooled and transported via the film transport system 142 to the film exit area 140. For ease of illustration, the film travel path is represented by dashed lines 146.

The film supply system 134 includes a cartridge receiving apparatus 148 and a film pick-up mechanism 150.

Figure 2:
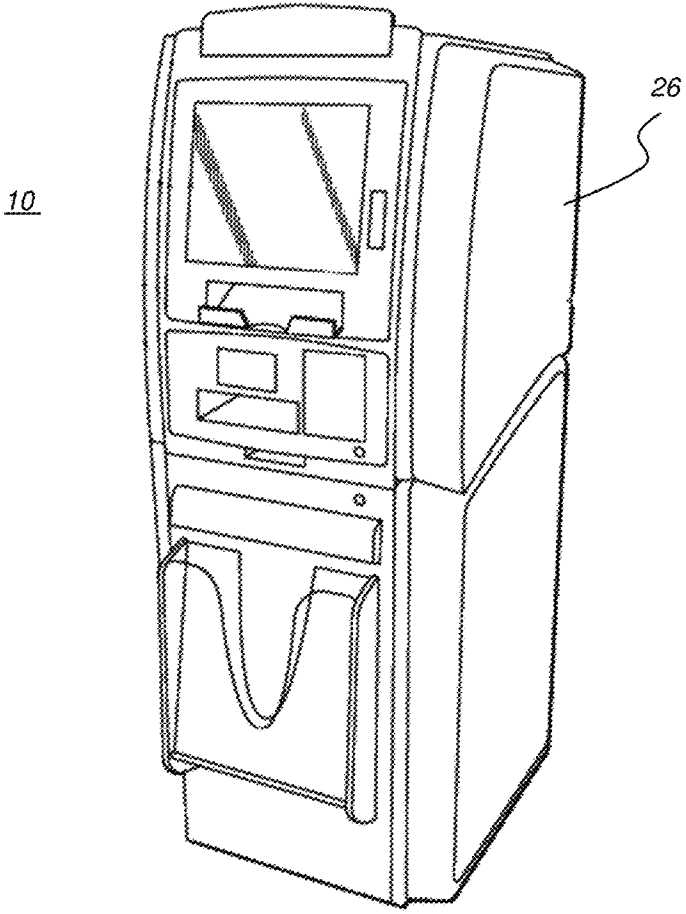
FIG. 2 is a perspective view showing a print kiosk according to an embodiment of the present disclosure.
Figure 3:
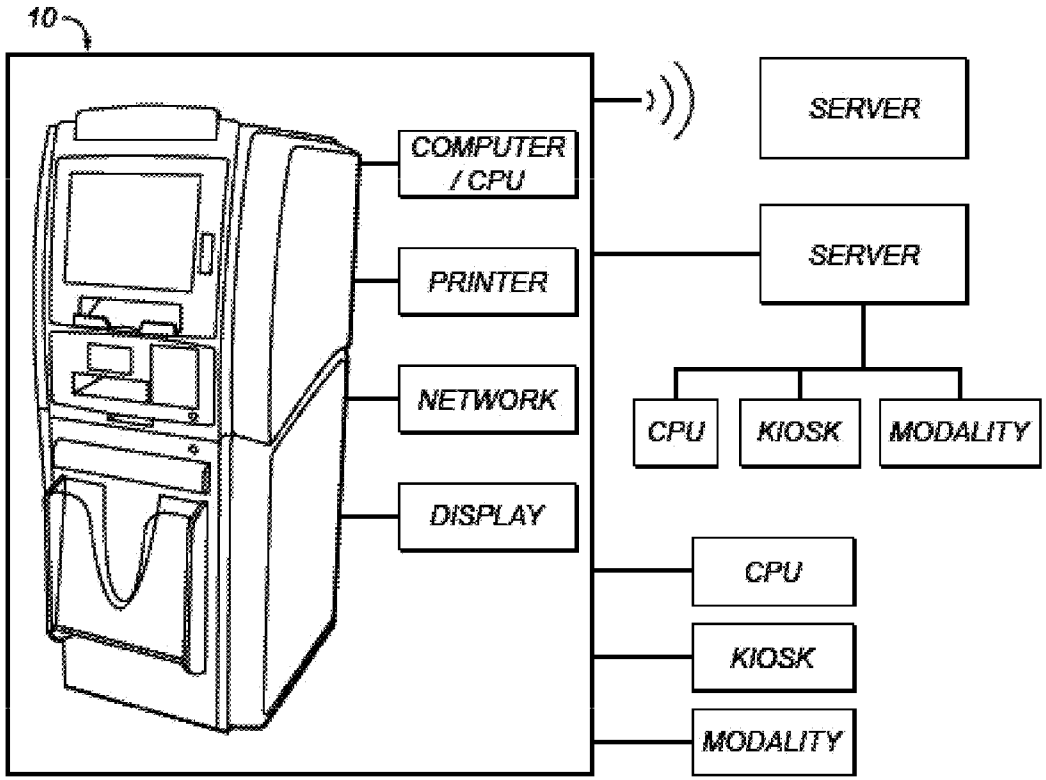
FIG. 3 is a schematic diagram showing functional components and interfaces of a self-serve print kiosk.

A laser imaging system 130 such as that shown in FIG. 1 can be incorporated into a self-service kiosk 10, as illustrated in FIGS. 2-3, and described in U.S. 2017/0092036 (Wiens) published on Mar. 30, 2017, entitled KIOSK WITH PRINTER AND ROTATABLE SUPPORT, incorporated herein in its entirety. In a number of kiosk embodiments, two types of printing systems can be provided, such as laser imaging system 130 for imaging onto transparent film along with a monochrome or color printer for printing onto paper or similar reflective media. Alternately, two different paper printing systems could be used, such as of different types and having different paper stock types and sizes.

Kiosk 10 can be a stand alone unit, or can include means to communicate with other devices. For example, kiosk 10 can include a CPU/computer or a communication device (wired or wireless technology) for access to a CPU/computer/server located remote from the kiosk to obtain/access medical data including records and images. Kiosk 10 can include a communication device (wired or wireless technology) to communicate with other devices to obtain/access medical data. These devices can include, for example, another kiosk, systems of various medical modality (for example, MRI, Computed Tomography, Cone Beam Computed Tomography, or the like), and/or a network server allowing access to other CPUs/computers/servers.

In Applicant's system/method, to help prevent a printer that is used within a kiosk or used in some other unattended application from running out of media (i.e., paper, photo-paper, film, photographic paper, and the like), the system/method monitors the media supply level using non-contact, optical sensing and generates a "low paper" alert, preferably in advance of the supply area becoming empty.

Applicant's solution is particularly suited for application in kiosk 10, including managing the media supply for a printer that runs in a relatively unattended mode, having service intervention only when prompted. Using a self-service kiosk 10 such as illustrated in FIG. 2, a patient can enter identifying information and obtain a hard copy report that includes one or more diagnostic images. This system/kiosk can include one or more printers, housed within a cover chassis 26. For example, in a preferred arrangement, the kiosk includes two high volume production paper printers, each with two media drawers (i.e., supply areas). Printers provided in the kiosk can be of the same type or of different types, such as printers that generate x-ray images on film in different size formats and printers that record onto paper media and generate full color image output, textual or graphical reports, and other data.

Without some type of low media detection and alert, a printer within kiosk 10 may run out of film or paper and be unable to start printing upon patient request. Or, if the media supply is exhausted during a print job, a requested report or series of images may print only partially, with the patient or other requester unaware that the full print job has not completed.

Using conventional monitoring approaches with kiosk printing systems, service personnel are generally alerted to a "no media" condition without any prior notice that the media supply is at low levels. Service personnel response can be delayed, inconveniencing patients and other print requesters.

Applicant's system/method adds a monitoring capability for the system to alert service personnel about low media supply status, with pre-determined "low paper" thresholds, i.e. approximate number of sheets of film or paper print substrate remaining in a tray when a "low paper" condition is triggered.

Applicant's system/method creates an advance warning, enabling the system to alert service personnel by displaying a message on the monitor screen or by sending an alert signal by other means.

Applicant's system/method can be used in a commercial (OEM), modular style system that has multiple media sizes and devices, including systems that print on different types of media or on different print media sizes. The solutions provided by the Applicant can be used on any of a number of printer types, including printers from different manufacturers, for example. The system described herein can sense multiple media sizes, maintaining sensors at the same location without obstructing movement of the printer tray(s), or without having excessive distance from the media edge.

Applicant's system/method uses optical sensing of the media supply level that can be configured and calibrated for the printer type that is used in a particular kiosk application. The Applicant's method can be used with any of a number of types of printers, including printers that record images onto film or paper. Advantageously, the method is not affected by variability in media sizes and fully or partially eliminates interference with internal parts and mechanisms of the printer, allowing it to be readily utilized for paper print systems using commercial OEM devices from various manufacturers.

Applicant's system/method for media supply sensing uses a reflective infrared sensor which is an analog device that outputs a gradually changing signal, based on the intensity of the reflected light, enabling the system to accurately determine media stack height. The sensor is in signal communication with control logic circuitry that analyzes the sensor signal to determine media level, either against a threshold "low media" value, or against a range of values indicative of media level. Advantageously, this type of sensing can be readily adapted to work with existing printer types that employ a media feeding mechanism conventionally used for paper printers of various sizes. In some applications, the Applicant's method can allow replacement or reconfiguration of printer types within a kiosk print system, requiring only minor recalibration for different media or printer types. The infrared sensing device is accurate in determining the media count when a suitable calibration method, as described below, is used.

Applicant's optical sensing system/method can be used having a sensor and associated printed circuit board (PCB) and cables installed completely outside an OEM (Original Equipment Manufacturer) printer, not requiring any OEM printer design change. Alternately, the sensing components can be fitted within an existing printer with minimal intrusion, as an add-on device, not interfering with printer paper-handling mechanisms and components and requiring minimal installation work. Communication between the sensor and control logic circuitry can be wired or wireless, such as using a Bluetooth or other high-frequency communication protocol.

Applicant has developed a system and method to increase accuracy of media supply/count detection and to avoid full or partial interference with internal parts of a printer. The method used by the Applicant employs non-contact surface sensing, with calibration that enables optical detection of media level based on thresholds set at calibration. Depending on printer configuration, the Applicant's method can use optical sensing of position of a mechanical surface within the device or reflection of light from an edge of the paper/film/media in the printer media drawer to reflect or block light. The Applicant's solution can be utilized among different types of printers and allows changes to be made to printer type using the same media level sensing hardware and logic control circuitry.

According to an embodiment, the surface of the lifting arm in the media feeder mechanism, located beneath the media stack for support from below, is used for sensing media level. A reflective sensor is energized to direct infrared (IR) light from below the printer, through the opening in the bottom of the media drawer and onto the bottom surface of the lifting arm of the feeder. Use of optical sensing in this way eliminates mechanical interaction with, or need of modification of, drawer or feeder mechanisms, especially when needed to enable the same detection method for different media sizes. Feeder arm behavior is the same for all sizes of compatible media, with different movement increments where media thickness changes from one type of media to another.

Rather than using visual (gradual) or magnetic (threshold) sensing of the feeder mechanism arm position, which gives very approximate information of remaining media level (possibly variable between printer loads and dependent on factors such as media sheet weight and overall printer condition), the reflected light is sensed to generate a variable analog signal which can be transformed into positional information for lifting arm proximity to the sensor. When used together with the calibration method described below, the analog signal output can be converted into accurate information about media stack height and corresponding remaining media count.

Applicant's method and system can be used with any printer type, but is especially suitable for use in a standalone imager, such as in kiosk printing system 10, as illustrated in FIGS. 2-3. As noted previously, such a kiosk systems can be configured to use various different types of commercial printers having different media types and sizes, depending on the particular requirements of a site. Embodiments of the present disclosure provide a method that adapts to different printer and media types and minimizes interference with printer components and mechanisms, allowing reconfiguration of a kiosk print system without requiring replacement of media supply sensing hardware. As shown in FIG. 3, kiosk 10 includes a computer and, optionally, one or more additional control logic processors for functions such as media level monitoring and reporting, and one or more printers, having a display that provides operator and service messages. The kiosk 10 is typically in signal communication with a network server that can provide additional computational resources and can allow access to various types of imaging apparatus of different modality, including radiographic, MRI, and ultrasound systems, for example.

FIGS. 4, 5, 6A, 6B, 7, and 8 show aspects of positioning and configuration for detecting low media levels for a printer used within a self-serve kiosk or similar hardware architecture.

Figure 4:
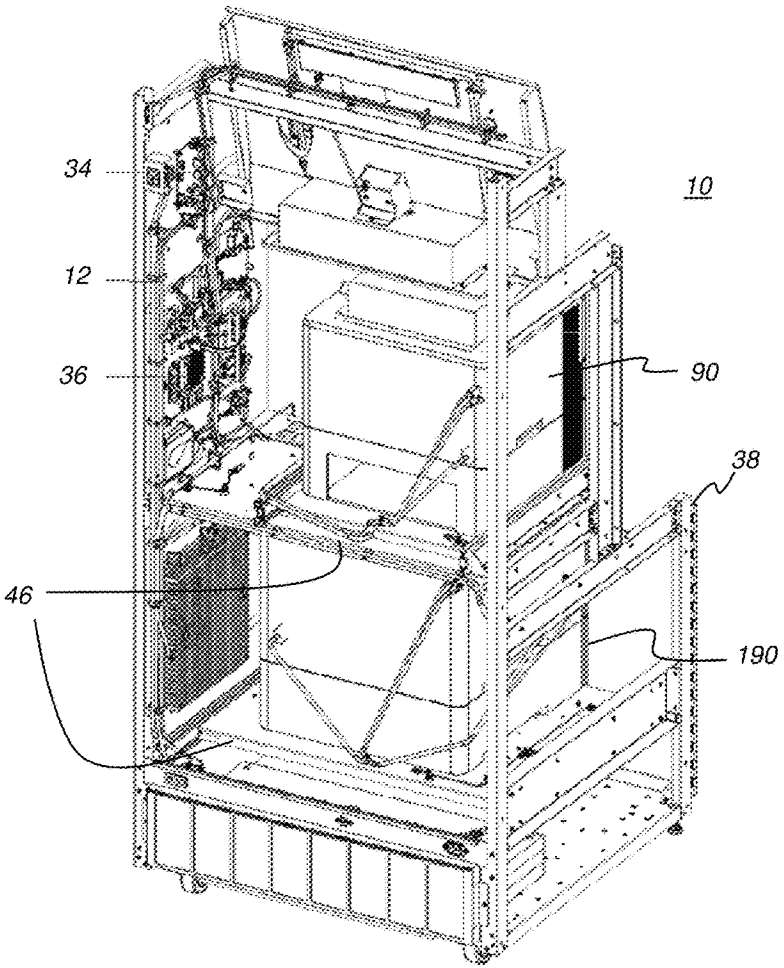
FIG. 4 is a perspective view that shows, from a rear view, internal components of a print kiosk with the outer chassis removed.

FIG. 4 shows, from a rear view perspective, a typical component layout within a frame 38 for kiosk 10, with cover chassis 26 (FIG. 2) removed. Media processing is provided by two imagers, an upper printer 90 and a lower printer 190. Printers 90 and 190 can be of different types, such as one for film, one for paper or other reflective media, or one printer for color images, the other for monochrome. Printers 90 and 190 can also be used for media of different sizes. Control logic for kiosk 10 functions is provided through one or more control logic processors on a control PCB 34 and a computer motherboard PCB 36. One or more cables 12 provide signal communication between these logic PCBs and other components.

Figure 5:
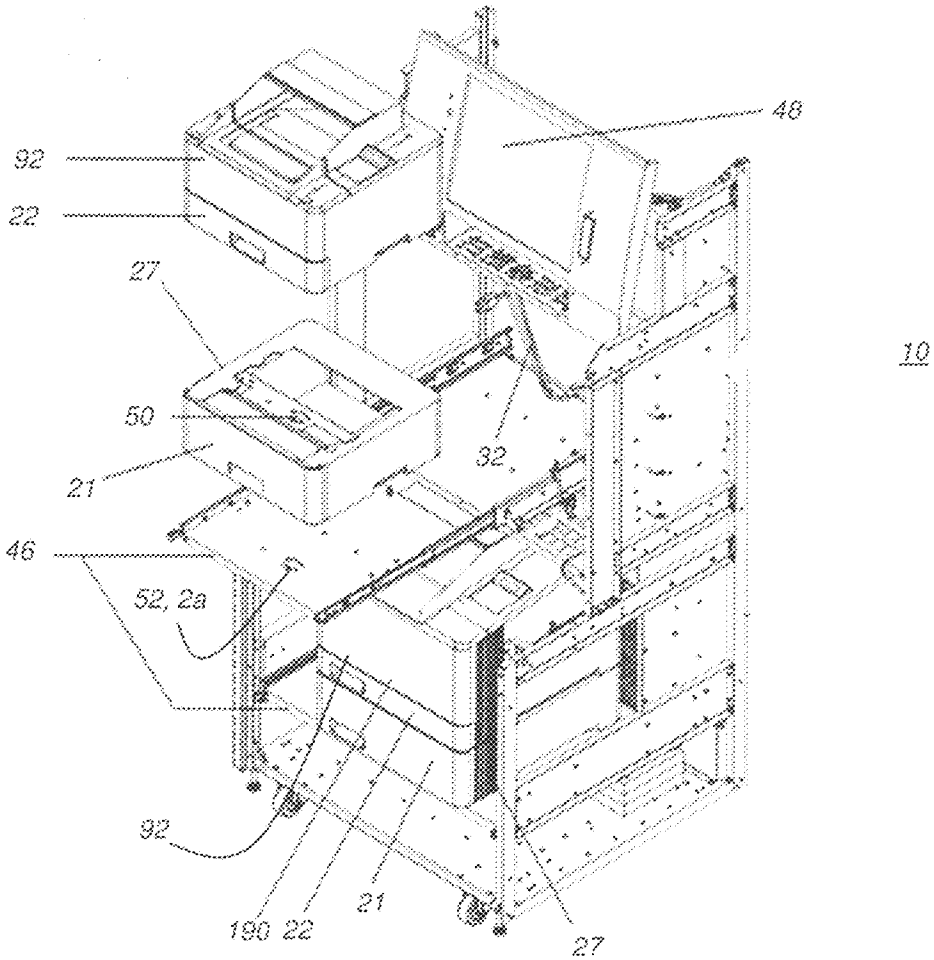
FIG. 5 is a perspective view that shows, from a front view, internal components of a print kiosk with the outer chassis removed and including printing and sensor apparatus related to media supply detection.

FIG. 5 is a front view, showing a partially exploded view arrangement of kiosk 10 for upper printer 90. In the configuration shown, printer 90 has two modular sections: a printer assembly 92 and an auxiliary feeder assembly 27. Each of printer assembly 92 and feeder assembly 27 has a media supply drawer with a lifting arm for providing media, as described in more detail subsequently. The same basic sensing components can be used for sensing the lifting arm in each media supply drawer, with a mounting arrangement suitable to the upper or lower position.

Figure 6A:
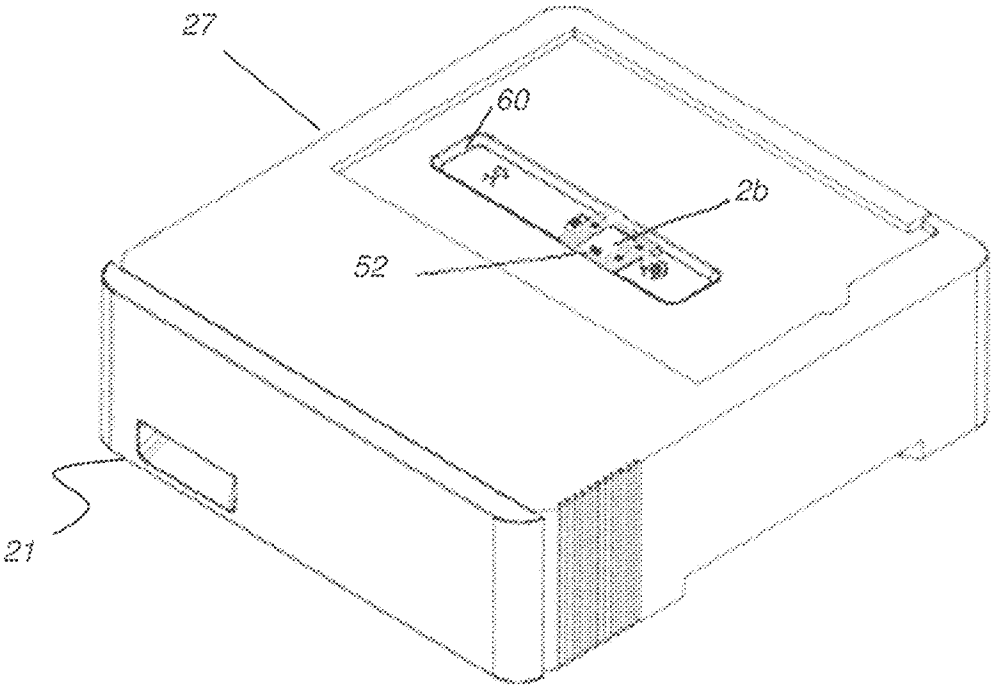
FIGS. 6A and 6B show different types of printer apparatus provided with media sensor components of the present disclosure.
Figure 6B:
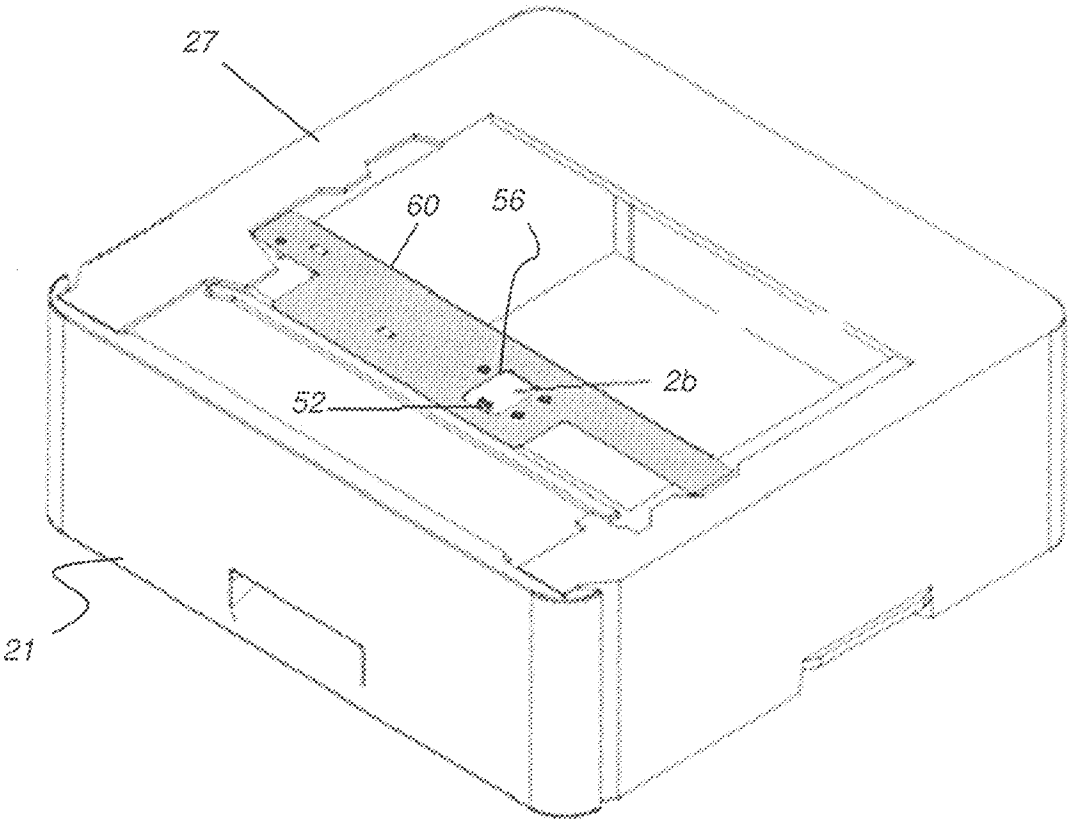

As shown in FIG. 5, each printer 90 and 190 is seated on a support/shelf 46 or other support and has a lower media supply drawer 21 and an upper media supply drawer 22. There is a printer assembly 92 for each printer 90, 190; each printer assembly 92 includes a corresponding upper media supply drawer 22. There is also an auxiliary feeder assembly 27 for each printer; each feeder assembly 27 includes a corresponding lower media supply drawer 21, as shown in FIGS. 6A and 6B. FIGS. 6A and 6B show feeder assemblies 27 for two different printer models, along with the corresponding components that are added for sensing the position of the lifting arm that is in the printer assembly 92 above.

Within kiosk 10, the printer support, shelf 46 as shown in FIGS. 4 and 5, can be rotatable about an axis, serving as a turntable to allow improved serviceability and positioning. This support can be rotated about an axis by any amount, for example, between 1 degree and 360 degrees. In a preferred arrangement, the support is rotatable about an axis by between 270 and 360 degrees. The embodiment of FIG. 5 shows shelf 46 on drawer slides, making shelf 46 expendable to facilitate printer access for setup, paper loading, and maintenance.

To monitor the media supply level, there is an IR sensing apparatus 50 associated with each type of media supply drawer 21, 22. A cable 32, as shown in FIG. 5, connects IR sensing apparatus 50 with control and computer motherboard PCBs 34, 36. A display monitor 48 provides an operator interface for kiosk 10 operation and shows alert messages related to media supply. As was shown in FIG. 3, a wired or wireless network connection also provides signal communication with other systems and devices for alerting support personnel to low media supply conditions.

IR sensing apparatus 50, provided for each media supply drawer 21, 22 as noted above, includes a light source, such as an infrared (IR) light source, that is energizable to direct a beam of light into the printer mechanism and a reflective infrared sensor 52, installed on Sensor PCB (printed circuit board) 2*a* or 2*b* connected by means of cable 32 or the like to Control PCB 34 which is, in turn, connected by means of cable 12 to Computer Motherboard PCB 36.

Figure 7:
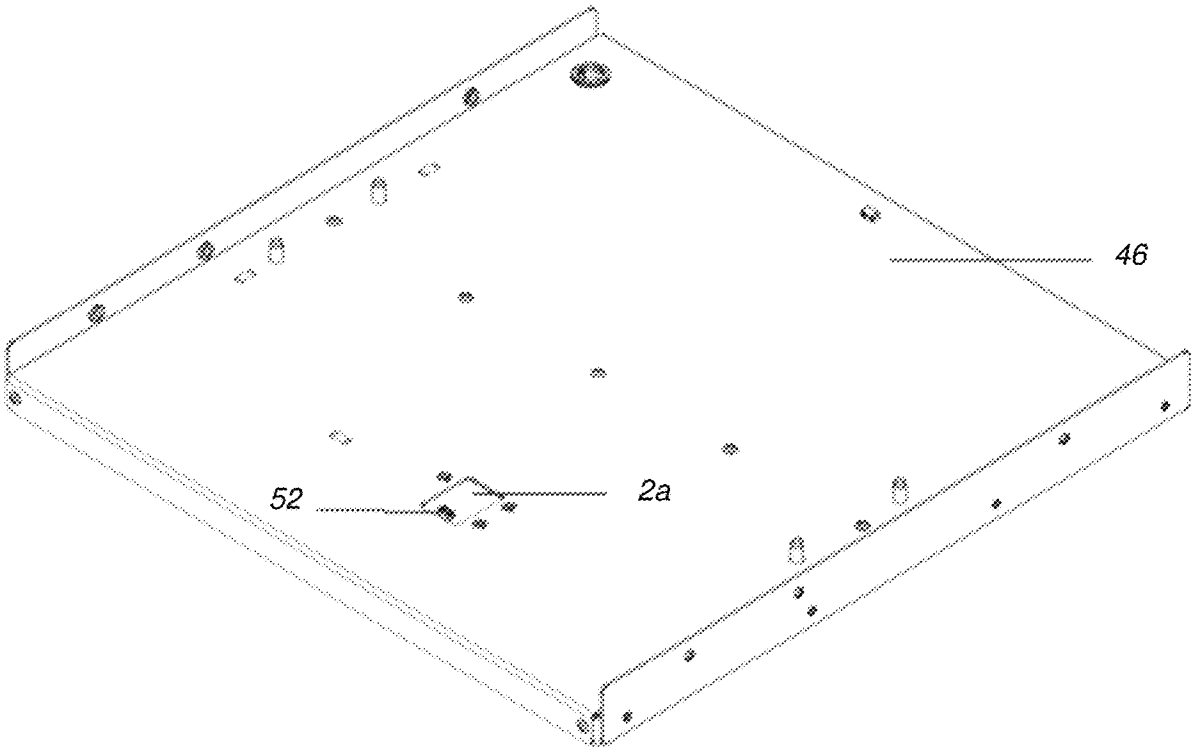
FIG. 7 is a perspective view that shows sensor apparatus provided on a printer support/shelf.

For lower media supply drawer 21, as shown in FIG. 7, sensor PCB 2*a* is installed outside printer 90, 190 and underneath a printer support, such as along a printer shelf 46, through a cutout portion that lies right below the lower media supply drawer 21. Sensor 52 directs IR light into the printer mechanism and senses reflection of the IR beam from a media supply lifting arm that rises when media is fed upward into the printer mechanism.

For upper media supply drawer 22, as shown for two different imager types in FIGS. 6A and 6B, sensor PCB 2*b* with sensor 52 is installed on top of feeder assembly 27 into a recession 56 in a plate 60, such as a sheet metal cover, bracket, or other holder that is to be positioned right below the bottom opening in the upper drawer 22. Plate 60 can be secured using tape, adhesive, or one or more fasteners, for example.

Figure 8:
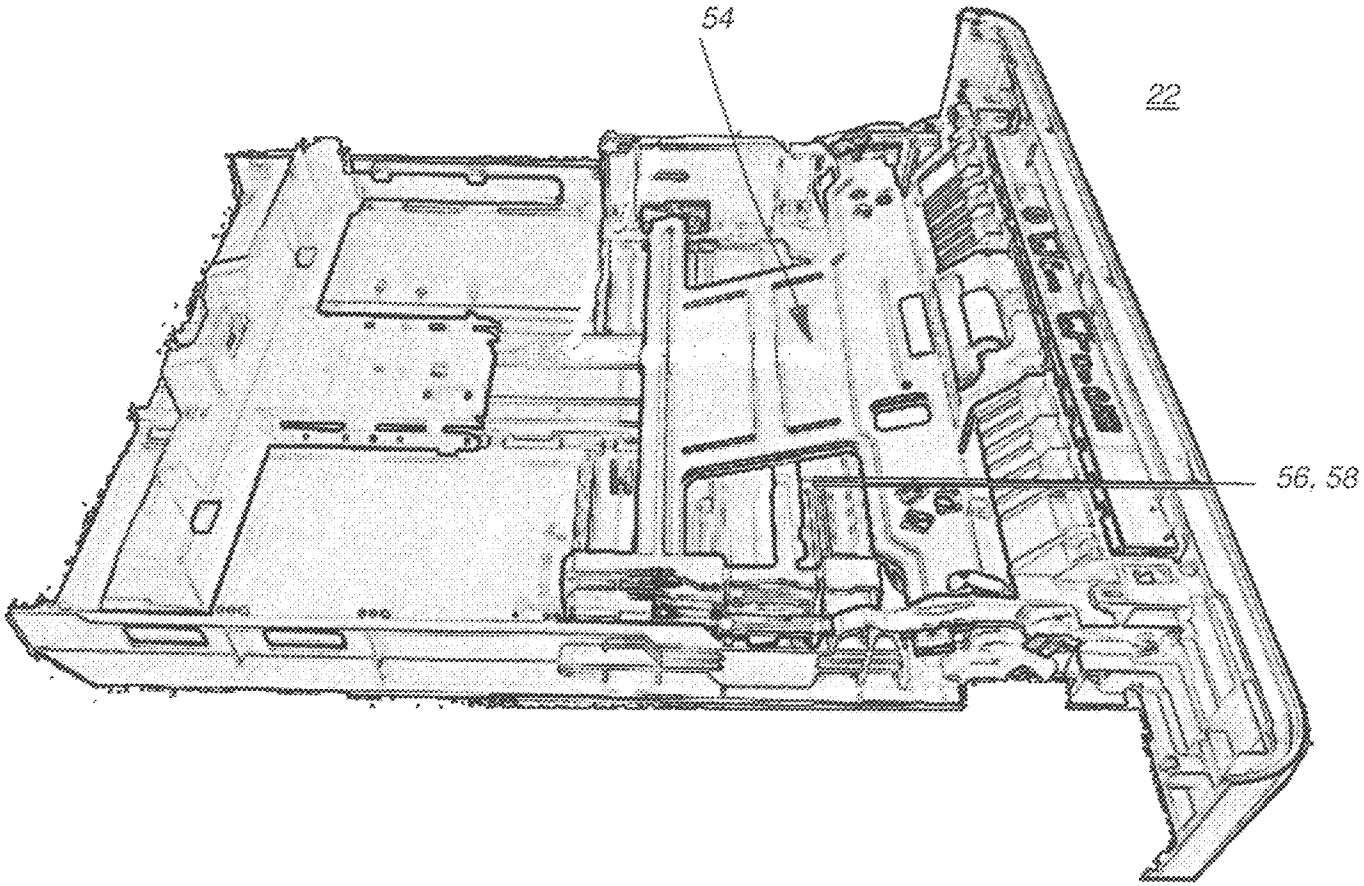
FIG. 8 is a perspective view that shows an upper media supply drawer.

The relative position of recession 56 and of the corresponding bottom opening 58 in upper drawer 22 is illustrated in FIG. 8. Sensor 52 (FIG. 7) directs IR light into the printer mechanism and senses reflection of the IR beam from a media supply lifting arm 54 or other type of media feed mechanism that raises when media is fed incrementally upward into the printer mechanism.

Referring to FIG. 8, lifting arm 54 rests on the drawer floor when printer 90, 190 is in standby mode. When printer 90, 190 is ready to feed media for printing, arm 54 is raised by the feeder mechanism up to the point when it starts compressing the media stack towards the feed rollers and the arm's movement stops. The range of travel of the arm between being raised with full stack of media on it (minimal travel) and with no media (maximal travel) is used as a proximity range for the sensor 52, affecting intensity of the reflected infrared light and corresponding output voltage of the sensor which is processed by the Control PCB 34 and Computer Motherboard PCB 36 as described in the work flow.

The work flow includes three functions: (i) Calibration; (ii) Media Stack Height Calculation (employed during printing); and (iii) Low Paper Alert.

Calibration:

Signal calibration is typically a one-time procedure, performed during kiosk 10 assembly or installation, or whenever the corresponding operating system application executes. The printer 90, 190 is set to a ready state. The upper media supply drawer 22 is empty. As a result, feeder lifting arm 54 in the drawer 22 is raised by a feeder mechanism to its maximal travel point. In response to detection of the reflected light beam from the associated light source, sensor 52 outputs the corresponding analog voltage level which is converted to digital value by the Control PCB 34 software. That value is sent to the Computer Motherboard PCB 36 and stored (i.e., such that the value is a predetermined value), representing a calibration baseline voltage, for further comparison with values generated when printer 90, 190 is in normal operation and the media supply drawer 22 contains a stack of media. A similar procedure is executed for lower media supply drawer 21.

Media Stack Height Calculation:

During printing, the feeder lifting arm 54 remains raised to a height that depends on the number of sheets of media remaining in the corresponding drawer 21, 22. On each print cycle, the sensor 52 output voltage is converted to a digital value by Control PCB 34 software and then compared with the baseline voltage by requesting its digital value from the Computer Motherboard PCB 36 and calculating a difference value using Control board software 34.

Low Paper Alert:

The resulting difference value from media stack height calculation is then compared, by a control logic processor, with a desired/pre-determined "low paper" threshold value. When this value goes below the threshold, a Low Paper alert is generated by Control PCB 34 software and is communicated to the Computer Motherboard PCB 36. This generates a Low Paper alert message and displays it on the monitor screen and/or notifies service personnel by other means, such as using a wireless signal. This calculation, if desired, can use and display information about type of media that is to be loaded in the drawer (paper, photopaper, film, media, or the like), correcting the pre-determined system threshold (approximate media count below which Low paper alert is generated) for the different thickness of different media types.

An embodiment of the present disclosure can use reflected light to report a low media condition, such as where fewer than 20 sheets, or fewer than some other number such as 12 sheets, remain in the printer. A low paper threshold can be determined by the user or site where the kiosk 10 is installed, to provide a threshold media amount that is practical at that location. Thus, for example, the kiosk 10 control logic processor can be instructed to compare the analog sensor value against a value when the number of sheets remaining is at a particular level. Since the analog value returned from sensor apparatus 50 can be continuously monitored, an approximate "sheet remaining" value can be reported to staff assigned to printer maintenance. The sheet remaining value can be accessible remotely, allowing the maintenance staff to query kiosk 10 periodically using a wireless signal device for obtaining approximate media count, as an aid to scheduling and job assignment, for example.

For reconfiguration, such as for installation of a different printer 90, 190 in kiosk 10, sensor apparatus 50 for the upper media supply drawer 22 can be repositioned. According to an embodiment, the same plate 60 can be used; alternately, plate 60 can be designed for the specific mechanical arrangement of a particular printer. The sensor apparatus 50 for the lower media supply drawer 21 is already in place on shelf 46. However, it may be necessary to shift the position of sensor apparatus 50. Shelf 46 can be fabricated to allow easy repositioning of sensor apparatus 50 for representative printer models. The calibration process can be repeated in order to put the newly installed printer into service.

It should be noted that sensor apparatus 50 is described using IR light, typically with wavelengths of about 700 nm or longer. However, light of other ranges can also be used, such as visible light, for example.

A computer program product may include one or more storage medium, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim.

In the following claims, the terms "first," "second," and "third," and the like, are used merely as labels, and are not intended to impose numerical requirements on their objects.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. A system for detecting a media supply level in a printer, comprising:

a frame having a support for seating the printer thereon;

a first light source positioned on the support and energizable to direct a first beam of light into a portion of the printer;

a first detector positioned on the support providing an analog signal in response to a reflection of the first beam of light from within the printer; and a control logic processor in signal communication with the first detector and adapted to compare the analog signal to a predetermined value and report a media supply level condition in response to the comparison.

2. The system of claim 1 wherein the light source directs infrared light into the printer.

3. The system of claim 1 further comprising a second light source in signal communication with the control logic processor and positioned within the printer to direct a second beam of light into another portion of the printer.

4. The system of claim 3 further comprising a second detector providing an analog signal in response to a reflection of the second beam of light, wherein the second light source and the second detector are mounted on a plate positioned on a feeder assembly within the printer.

5. The system of claim 1 wherein the first beam of light is directed to reflect light to the first detector from a media feed mechanism.

6. The system of claim 1 wherein the analog signal relates to an intensity of the reflection of the first beam of light from within the printer.

7. A method for detecting the level of a media supply in a printer, the method comprising:

providing a frame having a support for seating the printer thereon;

coupling a first light source and a first detector to the support;

energizing the first light source to direct a first beam of light into the printer;

acquiring an analog signal from the first detector in response to a reflection of the first beam of light from a portion of the printer;

comparing the analog signal to a predetermined value; and in response to the comparison, reporting a media supply level condition on a display.

8. The method of claim 7 further comprising calibrating the printer to acquire the predetermined value for an empty printer supply.

9. The method of claim 7 wherein reporting the media supply level condition comprises displaying a message on the display.

10. The method of claim 7 wherein reporting the media supply level condition comprises transmitting a wireless message.

11. The method of claim 7 wherein the predetermined level indicates a number of media sheets in the media supply of the printer.

12. The method of claim 7 further comprising, in response to the comparison, reporting an approximate number of media sheets in the media supply of the printer.

13. The method of claim 7 further comprising:

providing a second light source and a second detector coupled to a feeder assembly within the printer; and acquiring an analog signal from the second detector in response to a reflection of the second beam of light from the second light source.

14. The method of claim 13 wherein the first and second signals correspond to different sizes of media.

15. The method of claim 13 wherein the first and second signals correspond to different types of media.

16. A computer storage product having at least one computer storage medium having instructions stored therein causing one or more computers to perform the method of claim 7.

* * * * *